US007631849B2

(12) United States Patent
Chen

(10) Patent No.: US 7,631,849 B2
(45) Date of Patent: Dec. 15, 2009

(54) TRANSVERSAL SUSPENSION ROD FOR A CEILING FAN

(76) Inventor: Bi-Ju Chen, 2F, No. 3, Lane 20, Sec. 2, Ren-ai Rd., Jhongjheng District, Taipei City 100 (TW)

( * ) Notice: Subject to any disclaimer, the term of this patent is extended or adjusted under 35 U.S.C. 154(b) by 397 days.

(21) Appl. No.: 11/518,397

(22) Filed: Sep. 11, 2006

(65) Prior Publication Data

US 2008/0078912 A1 Apr. 3, 2008

(51) Int. Cl.
*F16M 13/00* (2006.01)

(52) U.S. Cl. ..... 248/547; 248/343; 248/906; 220/3.9

(58) Field of Classification Search ..... 248/343, 248/546, 547, 644, 342, 200.1, 906; 220/3.9
See application file for complete search history.

(56) References Cited

U.S. PATENT DOCUMENTS 4,659,051 A * 4/1987 Propp et al. ..... 248/546
4,909,405 A * 3/1990 Kerr, Jr. ..... 220/3.9
5,024,412 A * 6/1991 Hung et al. ..... 248/343
5,150,868 A * 9/1992 Kaden ..... 248/343
5,303,894 A * 4/1994 Deschamps et al. ..... 248/343
5,393,026 A * 2/1995 Deschamps et al. ..... 248/343
5,606,147 A * 2/1997 Deschamps et al. ..... 174/491
5,720,461 A * 2/1998 Kerr, Jr. ..... 248/317
6,909,045 B2 * 6/2005 Halbert ..... 174/50
7,255,312 B2 * 8/2007 Melic ..... 248/200.1
7,429,025 B1 * 9/2008 Gretz ..... 248/546
2002/0171019 A1 * 11/2002 Johnson et al. ..... 248/343

* cited by examiner

*Primary Examiner*—J. Allen Shriver, II
*Assistant Examiner*—Bradley H Duckworth
(74) *Attorney, Agent, or Firm*—Rabin & Berdo, P.C.

(57) ABSTRACT

A transversal suspension rod for a ceiling fan is primarily composed of an extensible tube rack set, an assembly member, and a wiring box. Upon implementing, the extensible tube rack set is supported between two parallel beams, then the wiring box is locked below the extensible tube rack set using the assembly member, and finally a bracket is locked at a bottom of the wiring box with screws to hang a ceiling fan, so as to decrease a difficulty in assembling with the assembly member.

5 Claims, 5 Drawing Sheets

TRANSVERSAL SUSPENSION ROD FOR A CEILING FAN

BACKGROUND OF THE INVENTION (a) Field of the Invention

The present invention relates to a transversal suspension rod for a ceiling fan and more particularly to a transversal suspension rod for a ceiling fan which is installed into a ceiling from a small opening to be supported and fixed between two beams, can be used safely, assembled conveniently, and is provided with a good firmness.

(b) Description of the Prior Art

Referring to FIG. 5 and FIG. 6, a conventional transversal suspension rod for a ceiling fan is primarily composed of an extensible tube rack set a, an assembly member b, and a wiring box c. Upon implementing, the extensible tube rack set a is supported between two parallel beams d, next the wiring box c is locked below the extensible tube rack set a using the assembly member b, and finally a bracket is locked at a bottom of the wiring box c by screws to hang a ceiling fan (not shown in the drawing).

As shown in the aforementioned conventional structures, the extensible tube rack set a includes an outer tube a1, an inner tube a2, two locking members a3 which are fixed at one end of the outer tube a1 and the other end of inner tube a2 respectively, and positioning plates a4 which are located at two ends of the tube rack set a respectively, with a plurality of thorns a41 projected on a surface at an exterior side of the positioning plate a4. In assembling, the outer tube a1 is first rotated to lock the locking member a3 which is fixed at the inner tube a2 end into one beam d, and to force the positioning plate a4 in front of the locking member a3 to be snapped into the beam d for fixing (the positioning plate a4 is also provided with an effect of keeping the extensible tube rack set a to be parallel to a ceiling). Next, the outer tube a1 is pulled out, enabling the positioning plate a4 and a locking member a3 which are fixed at the end of outer tube a1 to be close to another beam d. Finally, the outer tube a1 is rotated again to lock the locking member a3 which is fixed at the end of outer tube a1 into the beam d, and to force the positioning plate a4 in front of the locking member a3 to be snapped into the beam d, so as to achieve an object of fixing the extensible tube rack set a.

However, as screws a31 of the locking members a3 and the thorns a41 of positioning plates a4 are exposed out, they are easy to harm people or a surface of an appliance by a mistake. In addition, as the extensible tube rack set a needs to be pulled out manually in stretching the set, and is particularly more difficult to be extended at a smaller opening of ceiling, it will cause a difficulty in implementing.

Furthermore, the wiring box c of conventional structure is completely made by a metallic material, and an interior of the wiring box c is provided with a plurality of fixing holes or screw-holes (not shown in the drawing), and slots or openings for fixing electric wires (not shown in the drawing) in order to be widely adapted to all kinds of requirements; whereas those structures should be welded together by hardware elements such as bolts and nuts, which will increase a manufacturing cost and working hours. On the other hand, if there are no sufficient fitting facilities (such as wire-clipping slots, through-holes, or screw-holes, etc.) for simplification, then it will be inconvenient to install a ceiling fan. Accordingly, it is necessary to improve the aforementioned conventional structure.

SUMMARY OF THE INVENTION

The primary object of present invention is to provide a transversal suspension rod for a ceiling fan, wherein two ends of an extensible tube rack set are provided with hidden claws, and an interior of the extensible tube rack set is provide with an automatic elongation structure, so as to increase a safety of usage, and a convenience in installation.

Another object of the present invention is to provide a transversal suspension rod for a ceiling fan, wherein a wiring box is made by a metallic box and a plastic box which are pressed into one body with plastic rivets. An interior of the plastic box is integrally formed with a plurality of fixing holes and a plurality of side openings; whereas a center of the plastic box is surrounded by wire-clipping slots in a sawtooth shape, so as to provide a convenience to a user.

Still another object of the present invention is to provide a transversal suspension rod for a ceiling fan, wherein an opening place of a fixing hole of the plastic box of wiring box used for locking with an assembly member is provided with an inverted hook, so as to decrease a difficulty in assembling with the assembly member.

In order to achieve the aforementioned objects, interiors of the positioning plates sheathed at two ends of the extensible tube rack set are provided with the hidden claws, respectively. The positioning plate is a triangular plate, above which is transversally located with a round tube, and an interior of which is provided with a baffle. The positioning plate can be sheathed at an exterior of the corresponding locking member with an end of the round tube, and an interior of the other end of round tube is orderly provided with a claw-piece and a plug. A center of the aforementioned baffle is provided with a round hole and a plurality of long holes at a rim of the round hole. The claw-piece is in a ring-shape, a front end of which is provided with a plurality of thorns, and a rear end of which is provided with a plurality of abutting portions corresponding to the long holes of baffle. An end of the plug is a disk of a larger diameter, whereas the other end is a cylinder of a smaller diameter. The cylinder is flexible, can be transfixed into the round hole at the center of baffle, and its end part is formed outward with an inverted hook. A center of the plug is provided with a small hole for protruding a screw of the locking member. In assembling, the claw-piece is assembled into the round tube of positioning plate with the plug, and the abutting portions of claw-piece are transfixed into the baffle to be extended out by a pushing of the locking member, and can be snapped into beams by a pressure resulting from a rotation of the screws of locking members into the beams, such that the transversal suspension rod can be firmly supported and assembled.

According to the aforementioned structures, an automatic elongation structure is located between the locking members being fixed on the outer tube and inner tube of extensible tube rack set, respectively. The automatic elongation structure includes a spring and a gliding rod. The gliding rod can be abutted on the locking member fixed at the outer tube end, by an elastic force released from the spring, such that the outer tube can be extended out automatically, to achieve an object of quick elongation. Moreover, a notch and a hook tip which is projected inward are located on the outer tube, at a place close to an end opening of the locking member fixed at the inner tube. The notch and the hook tip are opposite to a lump and an L-shape slot on the locking member fixed at the inner tube, respectively. When the notch of outer tube is locked with the lump, the locking member of inner tube can be driven by the outer tube so that the locking member is rotated into the beam, and a locking state is formed when the hook tip of outer tube is latched into the L-shape slot. On the other hand, when the outer tube is reversely rotated to release the hook tip from the L-shape slot, an unlocking state is formed to release the elastic force, thereby achieving an effect of automatically and quickly elongating the extensible tube rack set.

Furthermore, the wiring box of present invention is made by a metallic box and a plastic box which are pressed into one body with the plastic rivets. The interior of the plastic box is integrally formed with the plurality of fixing holes, and the plurality of side openings; whereas the center of plastic box is surrounded by the sawtooth-shape wire-clipping slots, so as to facilitate assembling and to reduce working hours for manufacturing. On the other hand, the opening place of one fixing hole used for locking with the assembly member is provided with the elastic inverted hook which is projected inward, so as to decrease the difficulty in assembling with the assembly member.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
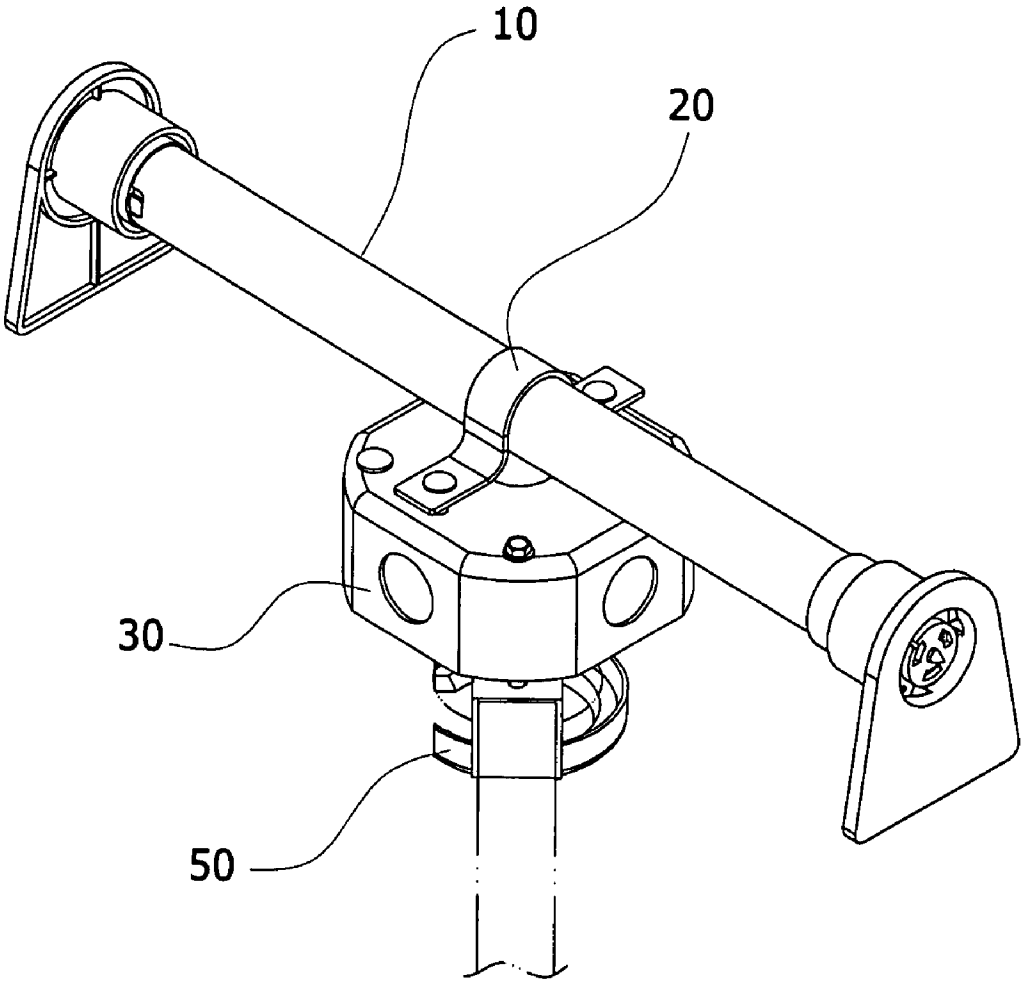
FIG. 1 shows a perspective view of an embodiment of the present invention.
Figure 2:
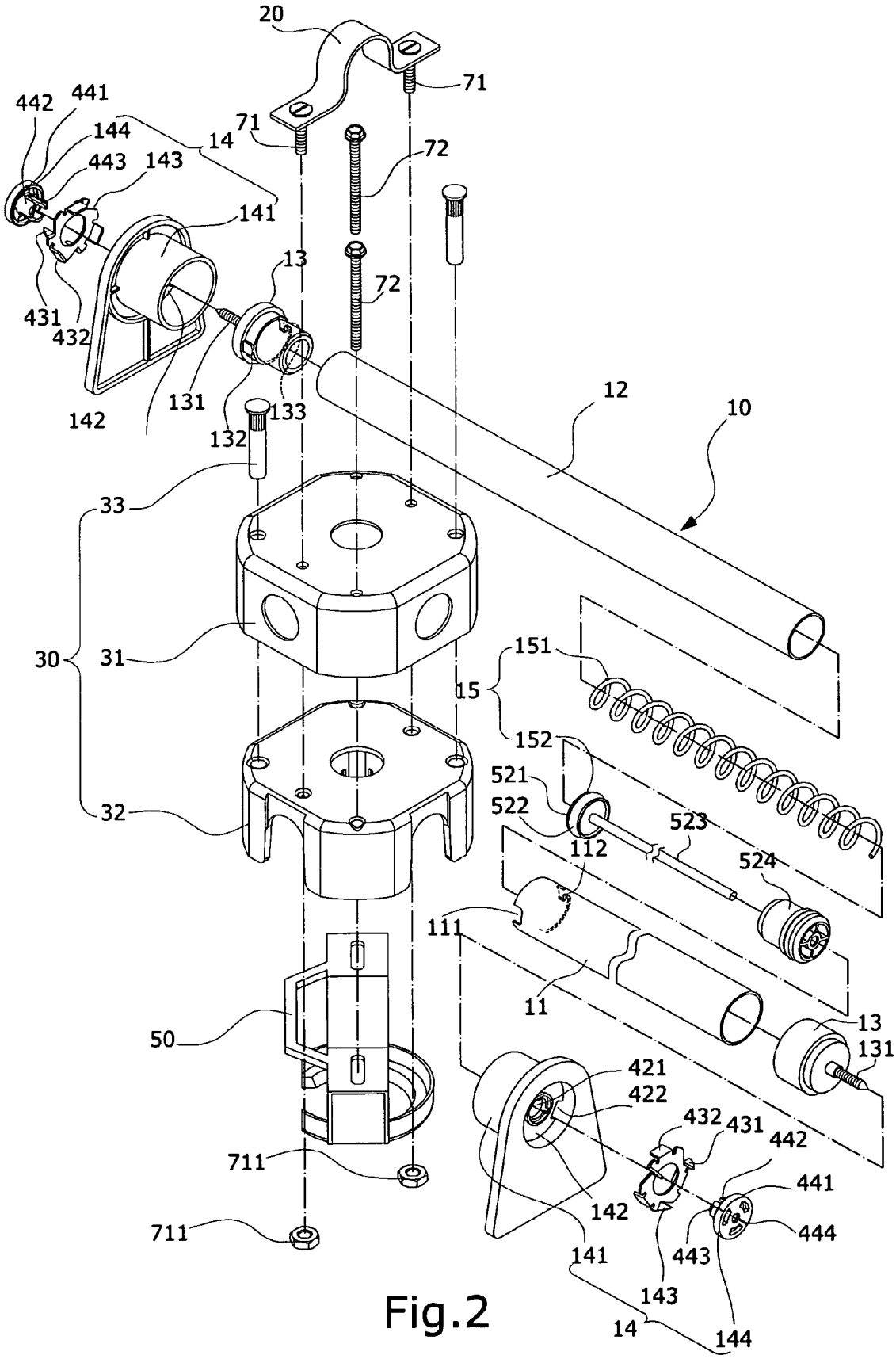
FIG. 2 shows an exploded view of the present invention.
Figure 3:
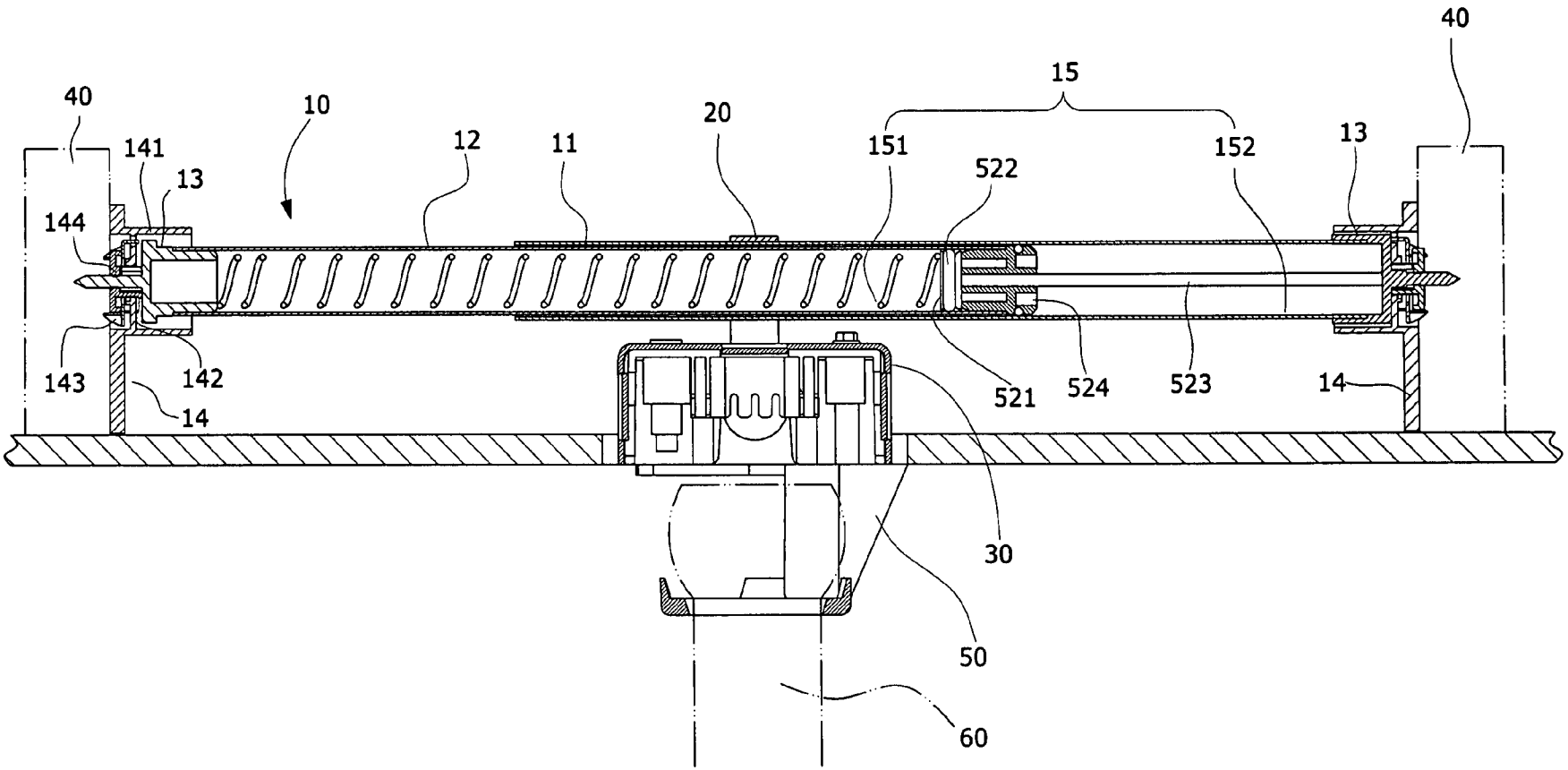
FIG. 3 shows a cutaway view of an embodiment of an entire assembly of the present invention.

Referring to FIGS. 1 to 3, a transversal suspension rod for a ceiling fan of the present invention comprises primarily an extensible tube rack set 10, an assembly member 20, and a wiring box 30, wherein, upon implementing, the extensible tube rack set 10 is supported between two parallel beams 40, next the wiring box 30 is locked below the extensible tube rack set 10 using the assembly member 20, and finally a bracket 50 is locked at a bottom of the wiring box 30 with screws to hang a ceiling fan 60.

The extensible tube rack set 10 includes an outer tube 11, an inner tube 12, and two locking members 13 which are fixed at one end of the outer tube 11 and the other end of inner tube 12, respectively. In addition, two positioning plates 14 which are provided with hidden claws are located at two ends of the tube rack set 10, respectively. The positioning plate 14 is a triangular plate, above which is transversally located with a round tube 141, and an interior of which is provided with a baffle 142. The positioning plate 14 can be sheathed at an exterior of the corresponding locking member 13 with an end of the round tube 141, and an interior of the other end of round tube 141 is orderly provided with a claw-piece 143 and a plug 144. A center of the aforementioned baffle 142 is provided with a round hole 421 and a plurality of long holes 422 at a rim of the round hole 421. The claw-piece 143 is in a ring-shape, a front end of which is provided with a plurality of thorns 431, and a rear end of which is provided with a plurality of abutting portions 432 corresponding to the long holes 422 of baffle 142. An end of the plug 144 is a disk 441 of a larger diameter, whereas the other end is a cylinder 442 of a smaller diameter. The cylinder 442 is flexible, can be transfixed into the round hole 421 at the center of baffle 142, and its end part is formed outward with an inverted hook 443. A center of the plug 144 is provided with a small hole 444 for protruding a screw 131 of the locking member 13. In assembling, the claw-piece 143 is assembled into the round tube 141 of positioning plate 14 with the plug 144, and the abutting portions 432 of claw-piece 143 are transfixed into the long holes 422 of baffle 142 to be extended out by a pushing of the locking member 13, and can be snapped into the beams 40 (as shown in FIG. 3) by a pressure resulting from a rotation of the screws 131 of locking members 13 into the beams 40, such that the transversal suspension rod can be firmly supported and assembled.

According to the aforementioned structures, an automatic elongation structure 15 is located between the locking members 13 being fixed on the outer tube 11 and inner tube 12 of extensible tube rack set 10, respectively. The automatic elongation structure 15 includes a spring 151 and a gliding rod 152. The gliding rod 152 can be abutted on the locking member 13 fixed at the outer tube 11 end, by an elastic force released from the spring 151, such that the outer tube 11 can be extended out automatically, to achieve an object of quick elongation. Whereas, for the aforementioned gliding rod 152, an outer circumference of its piston 521 is installed with an O-ring 522 to be tightly connected with the inner tube 12, and an end opening of the inner tube 12 being extended outward from an abutting rod 523 of the gliding rod 152 is provided with a sealing cap 524 having an inner hole of a diameter such that the abutting rod 523 can just pass through, and that air can be slowly drained out when the gliding rod 152 is moving outward, so as to prevent the extensible tube rack set 10 from bursting out while being elongated.

Moreover, a notch 111 and a hook tip 112 (as shown in FIG. 2) which is projected inward are located on the outer tube 11, at a place close to an end opening of the locking member 13 fixed at the inner tube 12. The notch 111 and the hook tip 112 are opposite to a lump 132 and an L-shape slot 133 on the locking member 13 fixed at the inner tube 12, respectively. When the notch 111 of outer tube 11 is locked with the lump 132, the locking member 13 of inner tube 12 can be driven by the outer tube 11 so that the locking member 13 is rotated into the beam 30, and a locking state is formed when the hook tip 112 of outer tube 11 is latched into the L-shape slot 133. On the other hand, when the outer tube 11 is reversely rotated to release the hook tip 112 from the L-shape slot 133, an unlocking state is formed to release the elastic force, thereby achieving an effect of automatically and quickly elongating the inner and outer tubes 11 and 12 of extensible tube rack set 10.

Figure 4:
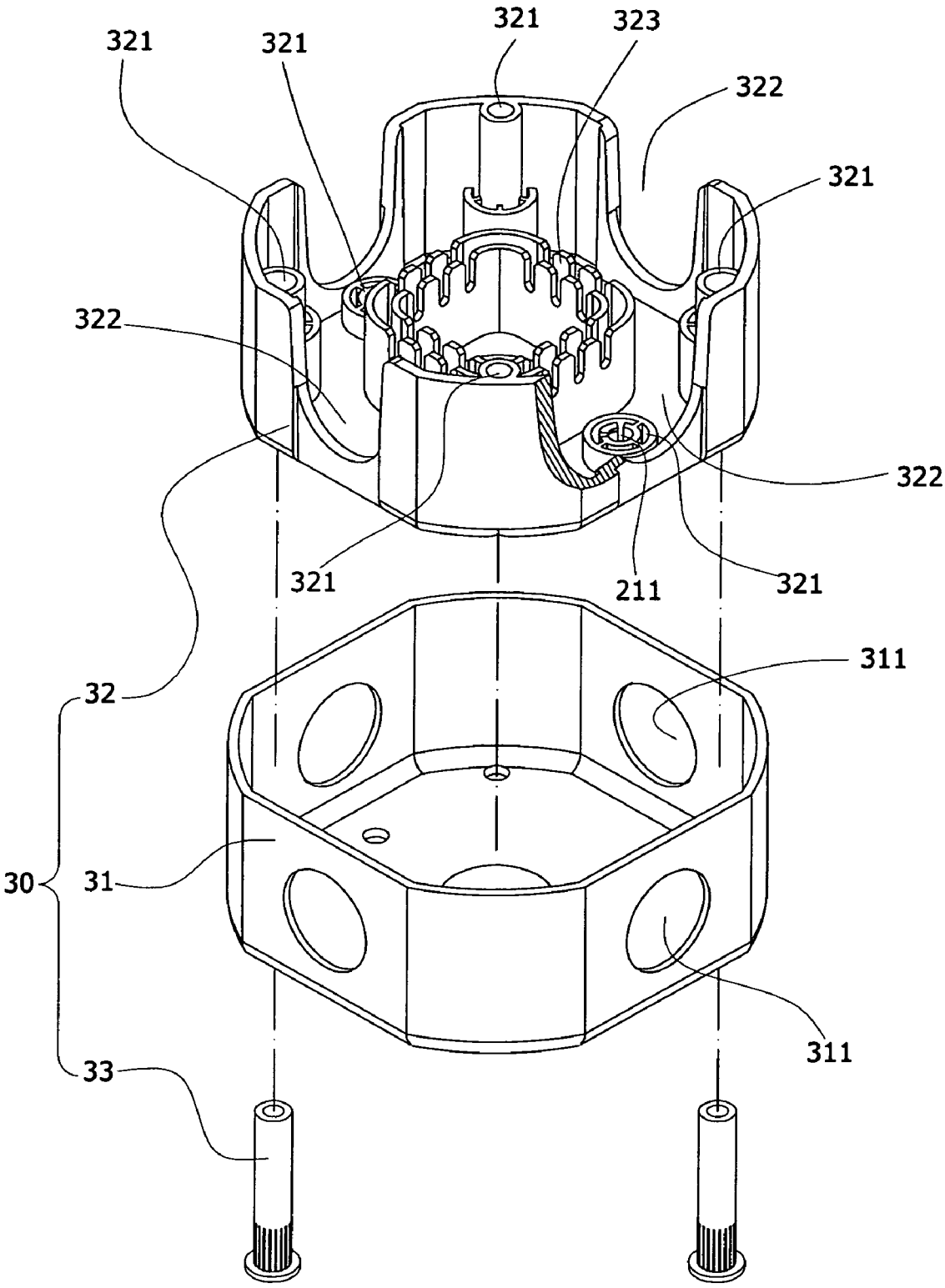
FIG. 4 shows an exploded view of a wiring box of the present invention.
Figure 5:
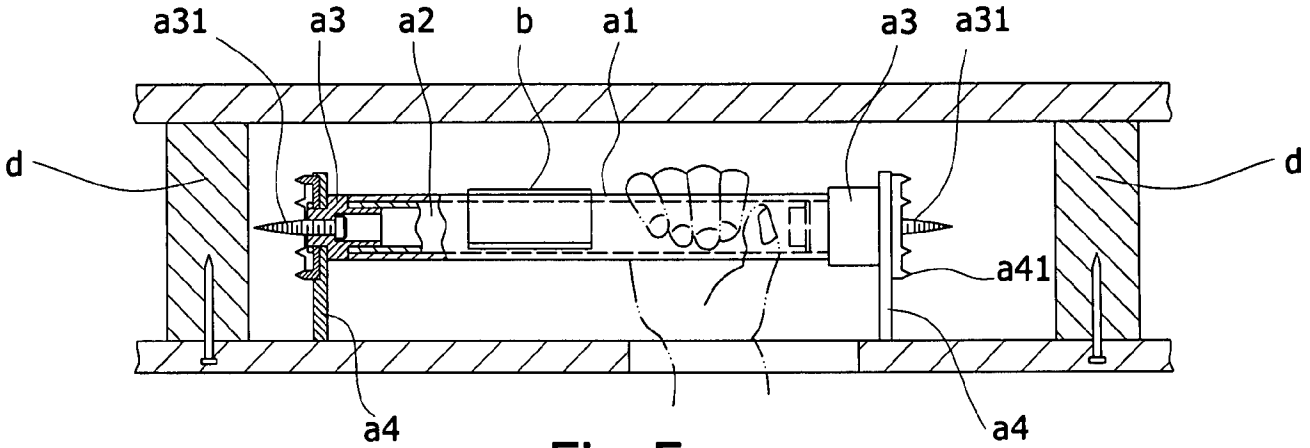
Fig.5 (Prior Art)
FIG. 5 shows a schematic view of a conventional transversal suspension rod for a ceiling fan.
Figure 6:
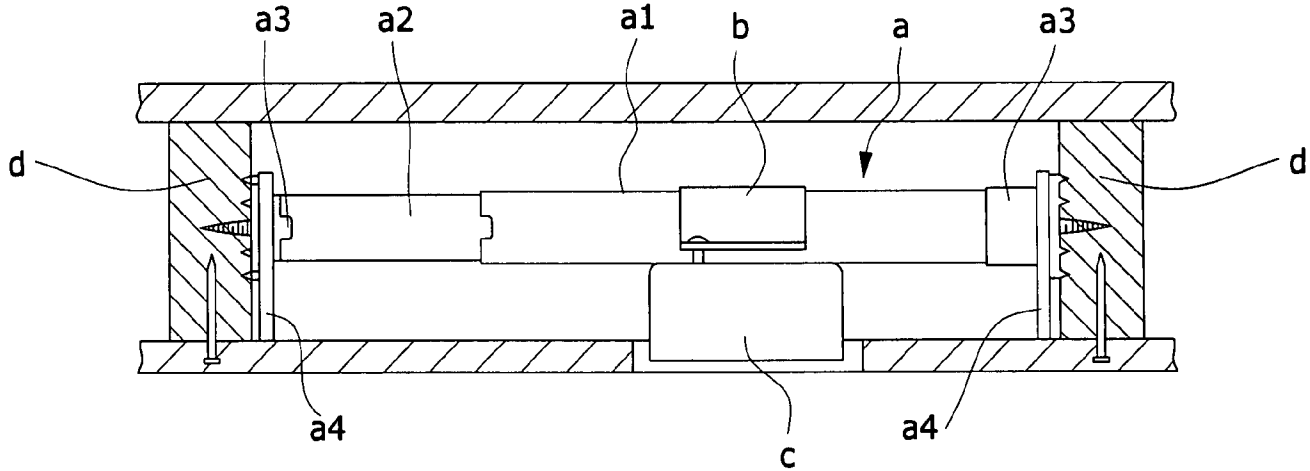
Fig.6 (Prior Art)
FIG. 6 shows another schematic view of a conventional transversal suspension rod for a ceiling fan.

On the other hand, the wiring box 30 of present invention is made by a metallic box 31 and a plastic box 32 being pressed into one body with plastic rivets 33 (as shown in FIG. 4). A plurality of fixing holes 321, and a plurality of side openings 322 are integrally formed on the plastic box 32, with wire-clipping slots 323 in a sawtooth shape surrounding a center of its interior. The aforementioned fixing holes 321 allow screws 71 of the assembly member 20, and screws 72, 73 for fixing the bracket 50 top-down or bottom-up, to be transfixed. The openings 322 are corresponding to pre-built holes 311 of the metallic box 31 to facilitate a connection of wiring tubes. By using a sawtooth-shape notch above the wire-clipping slot 323, an electric wire can be clipped and stabilized, enabling the wiring to be tidier and prettier, thereby further facilitating the assembling and reducing working hours for manufacturing.

In addition, an opening place of one fixing hole 321 used to lock with the assembly member 20 is provided with an elastic inverted hook 211 which is projected toward an interior of the hole. When one screw 71 is transfixed into the fixing hole 321, the screw 71 can be fixed in advance by a clipping of the inverted hook 211, so as to facilitate locking on a nut 711 and to decrease a difficulty in assembling with the assembly member 20.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A transversal suspension rod for a ceiling fan having an extensible tube rack set, an assembly member, and a wiring box, the extensible tube rack set is configured to be installed by being supported between two parallel beams, the wiring box is locked below the extensible tube rack set using the assembly member, and then a bracket is locked at a bottom of the wiring box with screws to hang a ceiling fan, the transversal suspension rod comprising:

the extensible tube rack set including an outer tube, an inner tube, and two locking members which are fixed at one end of the outer tube and another end of inner tube respectively, with two positioning plates located at two ends of the tube rack set, respectively;

each of the positioning plates being a triangular plate above which a round tube is transversally located, and an interior of each round tube is provided with a baffle, each of the positioning plates being sheathed at an exterior of the corresponding locking member with an end of the round tube, and an interior of the other end of round tube being provided with a claw-piece and a plug;

a center of the aforementioned baffle being provided with a round hole and a plurality of long holes at a rim of the round hole;

the claw-piece being in a ring-shape, a front end of which is provided with a plurality of thorns, and a rear end of which is provided with a plurality of abutting portions corresponding to the long holes of the baffle;

an end of the plug being a disk of a larger diameter, whereas another end being a cylinder of a smaller diameter, the cylinder being flexible, transfixed into the round hole at a center of the baffle, and an end part of which being formed outward with an inverted hook; and a center of the plug being provided with a small hole for protruding a screw of the locking member, wherein the wiring box is made by a metallic box and a plastic box being pressed into one body with plastic rivets, and an interior of the plastic box is integrally formed with a plurality of fixing holes, a plurality of side openings, with a center of the plastic box being surrounded by wire-clipping slots in a sawtooth shape.

2. The transversal suspension rod for a ceiling fan according to claim 1, wherein an automatic elongation structure is located between the locking members which are fixed on the outer tube and inner tube of extensible tube rack set respectively, and includes a spring and a gliding rod; the gliding rod being abutted on the locking member fixed at the outer tube end, by an elastic force released from the spring, such that the outer tube is extended out automatically.

3. The transversal suspension rod for a ceiling fan according to claim 2, wherein an outer circumference of a piston of the gliding rod is installed with an O-ring to be tightly connected with the inner tube, and an end opening of the inner tube extended outward from an abutting rod of the gliding rod is provided with a sealing cap having an inner hole of a diameter such that the abutting rod can just pass through, and that air can be slowly drained out when the gliding rod is moving outward.

4. The transversal suspension rod for a ceiling fan according to claim 2, wherein a notch and a hook tip which is projected inward are located on the outer tube, at a place close to an end opening of the locking member fixed at the inner tube; the notch and the hook tip being opposite to a lump and an L-shape slot on the locking member fixed at the inner tube, respectively.

5. The transversal suspension rod for a ceiling fan according to claim 1, wherein an opening place of a fixing hole used for locking with the assembly member is provided with an elastic inverted hook which is projected inward.

* * * * *

UNITED STATES PATENT AND TRADEMARK OFFICE

CERTIFICATE OF CORRECTION

PATENT NO. : 7,631,849 B2
APPLICATION NO. : 11/518397
DATED : December 15, 2009
INVENTOR(S) : Bi-Ju Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 492 days.

Signed and Sealed this

Second Day of November, 2010

David J. Kappos

David J. Kappos
*Director of the United States Patent and Trademark Office*